US007410216B2

(12) United States Patent
Rutman

(10) Patent No.: US 7,410,216 B2
(45) Date of Patent: Aug. 12, 2008

(54) TENSION ADJUSTMENT MECHANISM FOR A CHAIR

(75) Inventor: Matthew Rutman, Howell, MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 11/449,556

(22) Filed: Jun. 8, 2006

(65) Prior Publication Data

US 2008/0001453 A1 Jan. 3, 2008

(51) Int. Cl.
*A47C 1/024* (2006.01)
*A47C 1/038* (2006.01)
*A47C 3/026* (2006.01)

(52) U.S. Cl. ..... 297/300.4; 297/300.1; 297/300.2; 297/300.3; 297/300.8

(58) Field of Classification Search ..... 297/300.1, 297/300.2, 300.3, 300.4, 300.5, 300.8
See application file for complete search history.

(56) References Cited

U.S. PATENT DOCUMENTS

| | | | | |
|---|---|---|---|---|
| 3,031,164 | A | 4/1962 | Schopf | |
| 3,659,819 | A | 5/1972 | Wolters | |
| 4,603,905 | A * | 8/1986 | Stucki | 297/300.3 |
| 4,796,950 | A | 1/1989 | Mrotz, III et al. | |
| 4,818,019 | A | 4/1989 | Mrotz, III | |
| 4,865,384 | A | 9/1989 | Desanta | |
| 4,911,501 | A * | 3/1990 | Decker et al. | 297/300.8 |
| 5,046,780 | A * | 9/1991 | Decker et al. | 297/300.8 |
| 5,106,157 | A | 4/1992 | Nagelkirk et al. | |
| 5,121,934 | A * | 6/1992 | Decker et al. | 297/300.8 |
| 5,192,114 | A | 3/1993 | Hollington et al. | |
| 5,909,924 | A | 6/1999 | Roslund, Jr. | |
| 6,003,942 | A | 12/1999 | Haas | |
| 6,015,187 | A | 1/2000 | Roslund, Jr. et al. | |
| 6,382,724 | B1 | 5/2002 | Piretti | |
| 6,932,430 | B2 * | 8/2005 | Bedford et al. | 297/300.2 |
| 7,213,880 | B2 * | 5/2007 | Schmitz et al. | 297/300.2 |
| 7,213,886 | B2 * | 5/2007 | Schmitz et al. | 297/300.1 X |
| 2004/0183350 | A1 * | 9/2004 | Schmitz et al. | 297/300.1 X |
| 2007/0057553 | A1 * | 3/2007 | Roslund et al. | 297/300.2 |

* cited by examiner

*Primary Examiner*—Rodney B. White
(74) *Attorney, Agent, or Firm*—Flynn, Thiel, Boutell & Tanis, P.C.

(57) ABSTRACT

A tilt control mechanism for an office chair includes a spring assembly therein which controls the tilt tension on the back assembly. This tilt control mechanism includes a tension adjustment assembly having a radial adjustment arm which supports the legs of a pair of coil springs and a cooperating cam block which cooperates with the arm to drive the arm upwardly and downwardly to vary the tilt tension. The cam block is mounted on a threaded shaft and is displaceable sidewardly to either drive the arm and spring legs upwardly or downwardly depending upon the direction of travel of the cam block.

15 Claims, 7 Drawing Sheets

TENSION ADJUSTMENT MECHANISM FOR A CHAIR

FIELD OF THE INVENTION

The invention relates to an office chair and more particularly, to improvements in the tilt control mechanism of the office chair for adjusting the tilt tension generated in the mechanism to control rearward tilting of a back assembly.

BACKGROUND OF THE INVENTION

Conventional office chairs are designed to provide significant levels of comfort and adjustability. Such chairs typically include a base which supports a tilt control assembly to which a seat assembly and back assembly are movably interconnected. The tilt control mechanism includes a back upright which extends rearwardly and upwardly and supports the back assembly rearwardly adjacent to the seat assembly. The tilt control mechanism serves to interconnect the seat and back assemblies so that they may tilt rearwardly together in response to movements by the chair occupant and possibly to permit limited forward tilting of the seat and back. Further, such chairs typically permit the back to also move relative to the seat during such rearward tilting.

To control rearward tilting of the back assembly relative to the seat assembly, the tilt control mechanism interconnects these components and allows such rearward tilting of the back assembly. Conventional tilt control mechanisms include tension mechanisms such as spring assemblies which use coil springs or torsion bars to provide a resistance to pivoting movement of an upright relative to a fixed control body, i.e. tilt tension. The upright supports the back assembly and the resistance provided by the spring assembly thereby varies the load under which the back assembly will recline or tilt rearwardly. Such tilt control mechanisms typically include tension adjustment mechanisms to vary the spring load to accommodate different size occupants of the chair.

It is an object of the invention to provide an improved tilt control mechanism for such an office chair.

In view of the foregoing, the invention relates to an office chair having an improved tilt control mechanism which controls rearward tilting of the back assembly relative to the seat assembly.

The tilt control mechanism of the invention incorporates a tension adjustment mechanism which cooperates with a pair of coil springs that defines the tilt resistance being applied to the chair uprights. The tension adjustment mechanism includes a cam block movably supported on the control body which slidably engages a pair of spring legs of the coil springs. The cam block has an arcuate cam surface which cooperates with the spring legs wherein the cam block is driven sidewardly to move the spring legs upwardly or downwardly to respectively increase or decrease the spring load being applied by the coil springs to resist rearward tilting.

The cam block is mounted on a threaded drive shaft which shaft extends laterally across the tilt control mechanism and is rotatably supported on the control body. The end of the drive shaft extends to an end of the cam block wherein rotation of the drive shaft causes the cam block to reversibly move sidewardly beneath the spring legs, wherein the arcuate cam surface supporting the spring legs thereby controls displacement of the legs upwardly or downwardly depending upon the direction of movement of the cam block. In particular, the spring legs may move upwardly to increase tilt tension, or downwardly to reduce the tilt tension. This mechanism provides an improved tension adjustment mechanism that is easier to actuate for the occupant.

Other objects and purposes of the invention, and variations thereof, will be apparent upon reading the following specification and inspecting the accompanying drawings.

Figure 1B:
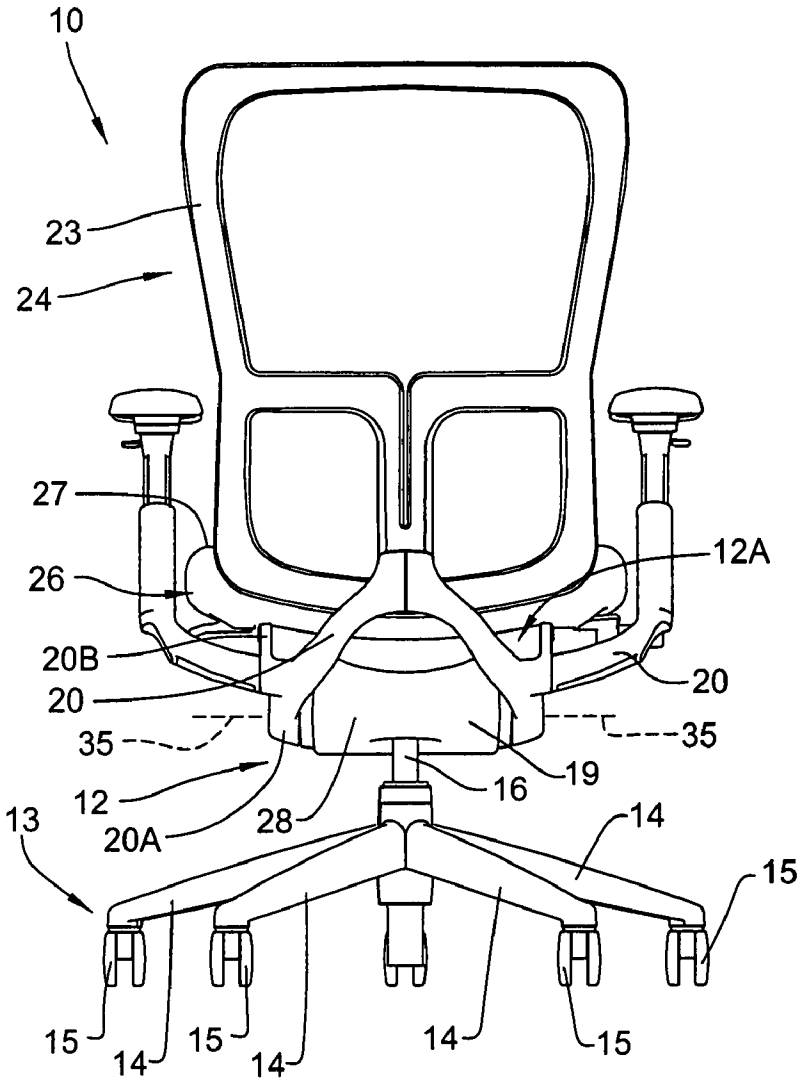
FIG. 1B is a rear elavational view thereof.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 1A:
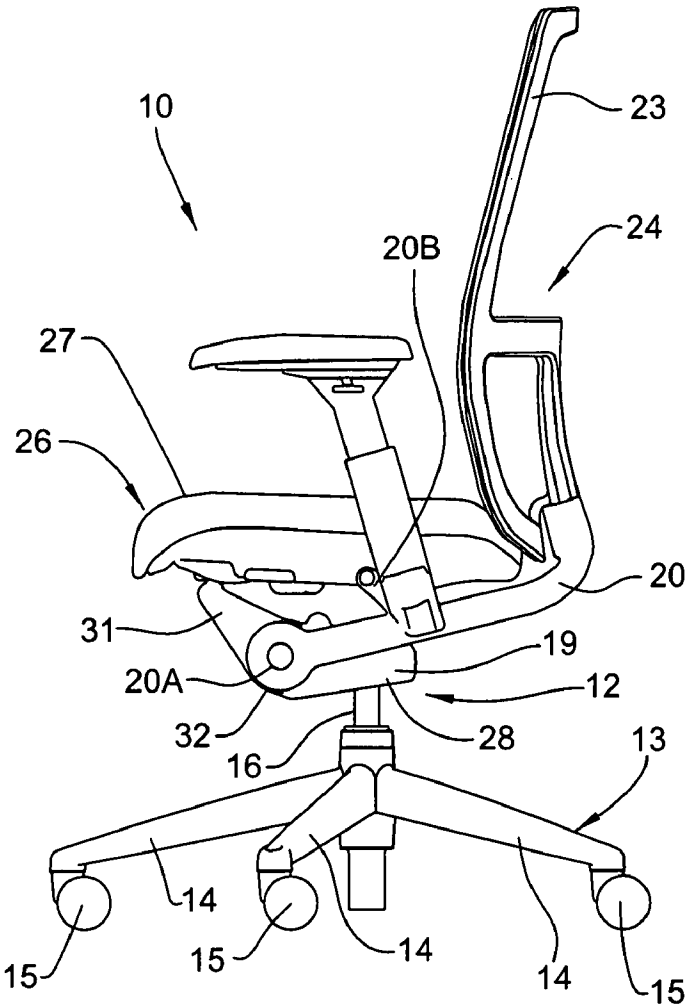
FIG. 1A is a side elevational view of an office chair of the invention.

Referring to FIGS. 1A and 1B, the invention generally relates to an office chair 10 which includes an inventive tilt control mechanism 12 wherein the tilt tension generated thereby may be adjusted to accommodate the different physical characteristics and comfort preferences of a chair occupant and also improve the assembly of the chair 10.

Generally, the chair 10 is supported on a base 13 having radiating legs 14 which are supported on the floor by casters 15. The base 13 further includes an upright pedestal 16 which projects vertically and supports a tilt control mechanism 12 on the upper end thereof. The pedestal 16 has a pneumatic cylinder 44 (discussed below) which permits adjustment of the height or elevation of the tilt control mechanism 12 relative to a floor.

The tilt control mechanism 12 includes a control body 19 on which a pair of generally L-shaped uprights 20 are pivotally supported by their front ends 20A. The uprights 20 extend rearwardly to support the back frame 23 of a back assembly 24. Additionally, the chair 10 includes a seat assembly 26 that defines an upward facing support surface 27 on which the seat of the occupant is supported.

Figure 2:
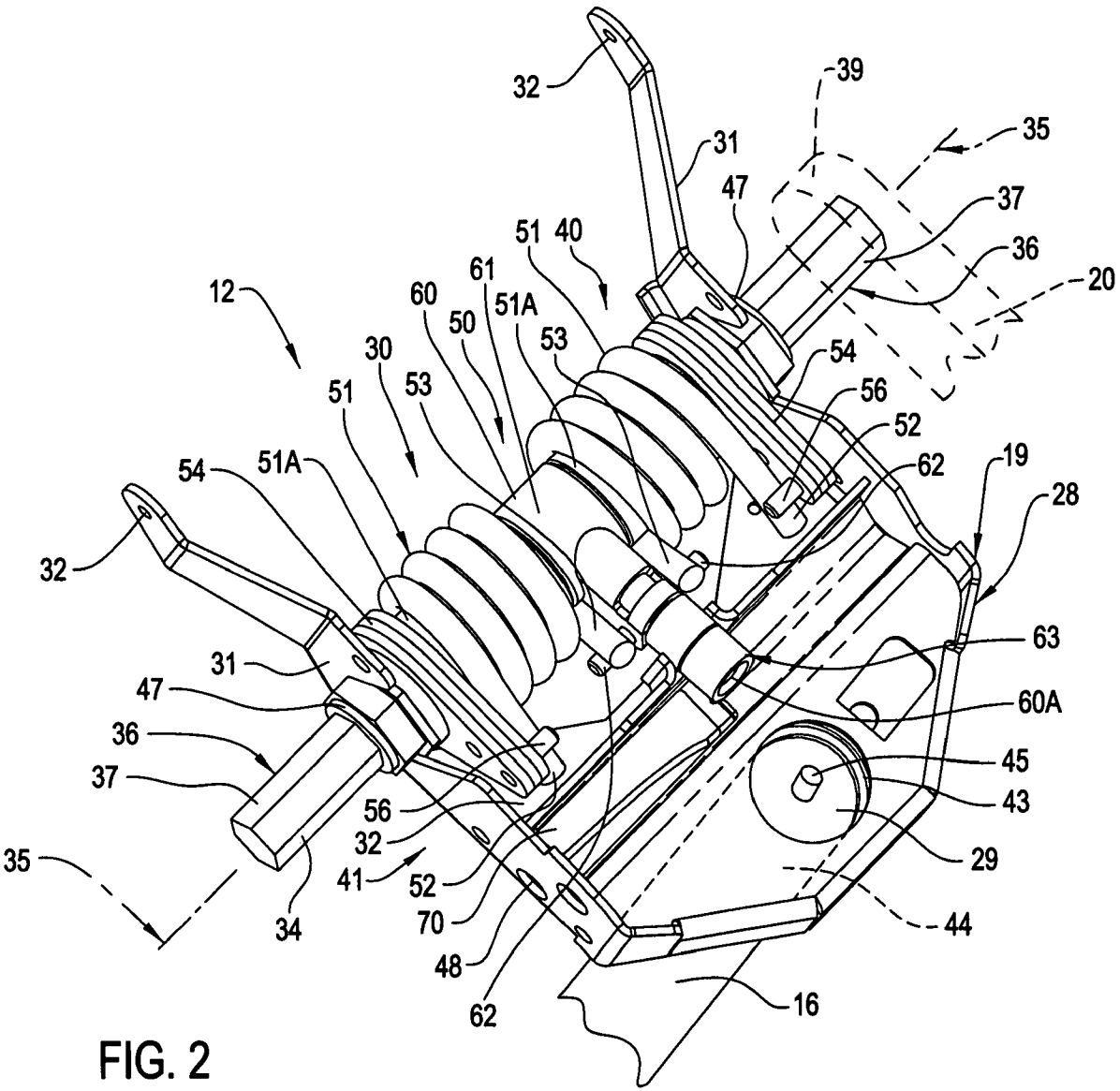
FIG. 2 is a front isometric view of a tilt control mechanism for the chair with a cam block in an initial position.

Referring more particularly to FIGS. 1A, 1B and 2, the control body 19 has a rear section 28 that is rigidly supported on the upper end 29 of the pedestal 16 and extends forwardly therefrom to define a forward compartment 30 between opposite side walls 31. The compartment 30 is enclosed on the bottom by a bottom wall 32 and during assembly, is open from above to receive the tilt mechanism components therein.

To support the uprights 20 on the control body 19, the side walls 31 (FIG. 2) include side openings in coaxial alignment with each other which receive a hex shaft 34 therethrough and define a rotation axis 35 about which the uprights 20 rotate. In particular, the shaft 34 includes outer ends 36 which project outwardly of the side walls 31 and each include a hex-shaped mounting portion 37 to which the front upright ends 20A are mounted so that rotation of the uprights 20 in response to tilting of the back assembly 24 causes a corresponding rotation of the support shaft 34.

In particular, the uprights 20 are pivotally connected at their front ends 39 to the sides of the tilt control mechanism 19 through the shaft 34 so as to pivot downwardly in unison about axis 35. The uprights 20 are adapted to pivot in a downward direction during reclining of the back assembly 24 and also may pivot upwardly about axis 35 to a limited extent in the counter direction to permit forward tilting of the seat assembly 26.

Each upright 20 also is connected to the rear of the seat assembly 26 by mount 20B (FIGS. 1A and 1B) wherein the front of the seat assembly 30 is pivotally supported on the control body 19. As such, downward pivoting of the uprights 20 causes the back of the seat assembly 26 to be lowered while forward tilting of the chair causes the back of the seat assembly 26 to lift. The combination of the tilt control mechanism 12, uprights 20 and seat assembly 26 effectively defines a linkage that controls movement of the seat assembly 26 and also effects rearward tilting of the back assembly 24. Typically, the tilt control mechanism 12 would include an appropriate cover arrangement 12A (FIG. 1B) which is not illustrated in FIGS. 2-5 in order to better illustrate the components of the tilt control mechanism 18.

More particularly as to FIG. 2, the tilt control mechanism 12 includes the control body 19 which pivotally supports the hex shaft 34 on which are supported the uprights 20. The uprights 20 when connected to the exposed shaft ends 37 pivot in unison with the shaft 34 about the horizontal tilt axis 35 wherein a spring assembly 40 is provided internally in the compartment 30 to apply tilt tension to the shaft 34. This tilt tension resists rotation of the shaft 34 while still permitting pivoting of the shaft 34 about the tilt axis 34 during rearward tilting of the back assembly 24. To adjust this tilt tension, the spring assembly 40 cooperates with an adjustment assembly 41 that varies the spring load generated by the spring assembly 40 and varies this tilt tension.

Referring more particularly to FIG. 2, the control body 19 is formed of steel plate which comprises the pair of side walls 31 that are supported on the control body bottom wall 32. The back end of the control body 19 includes the brace section 28 which includes a cylindrical cylinder mount or plug 43 in which is received the upper end 29 of the pneumatic cylinder 44. The upper end of the pneumatic cylinder 44 includes a conventional cylinder valve 45 (projecting upwardly therefrom). This cylinder mount 43 is rigidly connected to the upper end of the pedestal 16 so that the tilt control mechanism 12 is rigidly connected to the base 13.

To support the shaft 34 and spring assembly 40, the side walls 31 of the control body 19 include a pair of bushing assemblies 47 (FIGS. 2 and 3) for rotatably supporting the shaft 34 therein. Additionally, the side walls 31 each include an adjustment shaft opening 48 (FIGS. 2 and 3) to support an end of the adjustment assembly 41 as will be described in further detail hereinafter.

More particularly as to the spring assembly 40, this assembly 40 is mounted on a center portion 50 of the support shaft 34 and further includes a pair of coil springs 51 which are mounted on cylindrical bushings 51A and each include upper spring legs 52 acting upwardly and lower spring legs 53 acting downwardly. These springs 51 are biasing members preferably defined as coil type springs although this mechanism is usable with a tension spring or other spring types. Still further, a radial control bracket 54 is also fixedly mounted on each end of the shaft 34 so as to rotate therewith. The control brackets 54 project radially outwardly in unison and rearwardly from the shaft 34 and include inwardly projecting stop flanges 56 which extend over and thereby capture the upper spring legs 52 respectively.

The upper spring legs 52 bear upwardly against the stop flanges 56 such that rotation of the shaft 34 causes the control bracket 54 to pivot and deflect the upper spring legs 52 downwardly relative to the lower spring legs 53. This relative deflection between the spring legs 52 and 53 therefore generates an increased tilt tension or tilting resistance acting torsionally on the shaft 34 which tilt tension resists rearward tilting of the uprights 20.

Additionally, the spring assembly 40 includes a central adjustment arm 60 which projects radially rearwardly towards the adjustment assembly 41 and is rotatable about the shaft 34 but does not rotate therewith. In particular, the adjustment arm 60 includes a mounting hub 61 which surrounds the central shaft section 50. The arm 60 on its rearward free end includes a pair of outwardly projecting support flanges 62 (FIGS. 2 and 3) which each support a respective one of the lower spring legs 53 thereon, such that rotational displacement of the adjustment arm 60 about the center shaft portion 50 causes or permits vertical displacement of the spring legs 53.

Also, the rearward free end of the adjustment arm 60 includes a roller unit 63 projecting rearwardly therefrom which is a rigid extension 60A of the arm 60 but defines a roller rotation axis.

Generally, the adjustment assembly 41 acts upon the roller unit 63 to deflect the lower spring legs 53 relative to the front spring legs 52 and vary the initial tilt tension which also varies the overall tilt tension generated during rearward tilting of the uprights 20. It is noted that circumferential displacement of the adjustment arm 60 about axis 35 varies the relative deflection between these upper and lower spring legs 52 and 53. Since the control brackets 54 supporting the upper legs 52 pivot in unison with the shaft 34, any adjustment of the upper legs 52 relative to the position of the lower spring legs 53 causes the springs 51 to generate an increased or decreased spring load that resists rotation of the shaft 34 and thereby resists rearward tilting of the uprights 20.

Further, the adjustment assembly 41 includes a contoured cam block 70 which has the lower spring legs 53 pressing downwardly thereon through the roller unit 63. The radial adjustment arm 60 therefore is pressed downwardly against cam block 70 under the resilient biasing of the lower spring legs 53. The adjustment arm 60 may in turn be reversibly displaced upwardly in response to sideward movement of the cam block 70 wherein the cam block. 70 may be selectively moved inwardly or outwardly in response to rotation of a drive shaft 71 (FIG. 3) to effect raising and lowering of the arm 60 and adjustment of the tilt tension.

With the above-described arrangement, the tilt tension being applied to the support shaft 34 may be readily adjusted.

More particularly, to support the components described above, the control body 19 includes a support wall 75 (FIG. 3) which extends upwardly. The support wall 75 includes an upward opening guide slot 76 (FIGS. 3-5) which is defined by a bottom edge 77, and opposed side flanges 78 and 79 defined by forwardly inturned plate material. These side flanges 78 and 79 confine sideward movement of the roller unit 63 while permitting vertical travel of the roller unit 63 through the vertical slot 76. In particular, the roller unit 63 comprises a first guide roller 80 which rolls along the guide slot 77. As will be described in further detail, the roller unit 63 further comprises a second driven roller 81 which contacts and rolls during relative movement of the cam block 70. The two rollers 80 and 81 are each mounted coaxially on a common support axle 82 (FIG. 4) of the adjustment arm 60 so as to be freely rotatable and move vertically in unison during vertical swinging of the adjustment arm 60.

Figure 3:
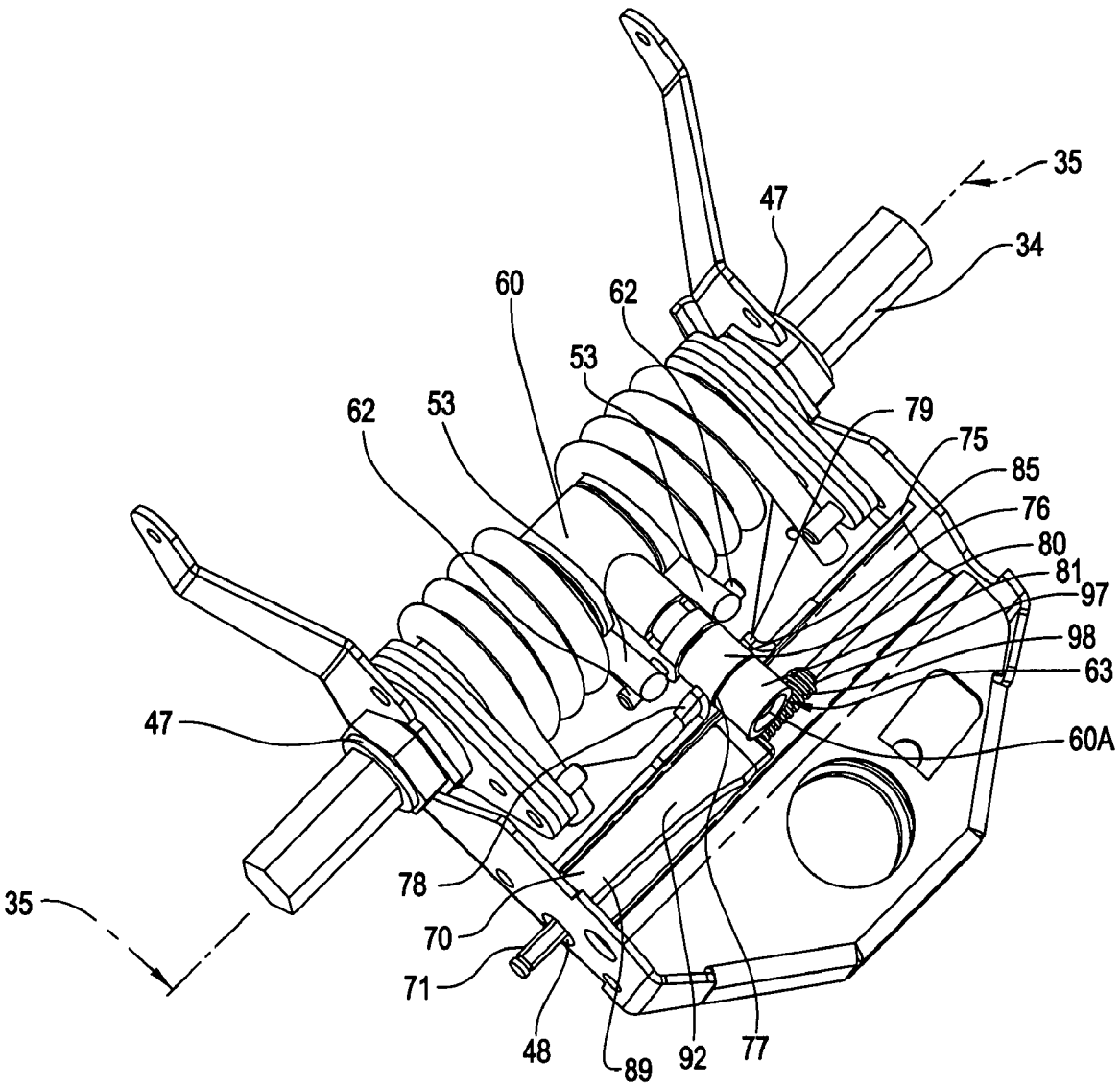
FIG. 3 is a front isometric view illustrating the cam block with a drive shaft connected thereto.

The plate material forming the support wall 75 is bent rearwardly to form a V-shaped guide channel or track 85 (FIG. 3) which extends horizontally across the width of the control body 19. This guide channel 85 opens upwardly to slidably receive the cam block 70 therein as seen in FIG. 3 and limits or confines movement of the cam block 70 to a linear path extending in a direction transverse to the vertical movement of the arm 60. Rearwardly of the channel 85, the plate material extends upwardly and rearwardly to define the rear body portion 28 to which the pedestal 13 is connected.

Turning to the cam block 70, this block 70 is formed of a suitable rigid yet low friction material. The bottom base 87 of the block 70 has a bottom curved surface 88 (FIG. 6) which rides along the opposing surfaces of the guide channel 85. The base 87 extends across the length of the block 70 so that the bottom surface 88 defines a continuous, uniform bottom surface profile when viewed from the end as seen in FIG. 6.

Figure 4:
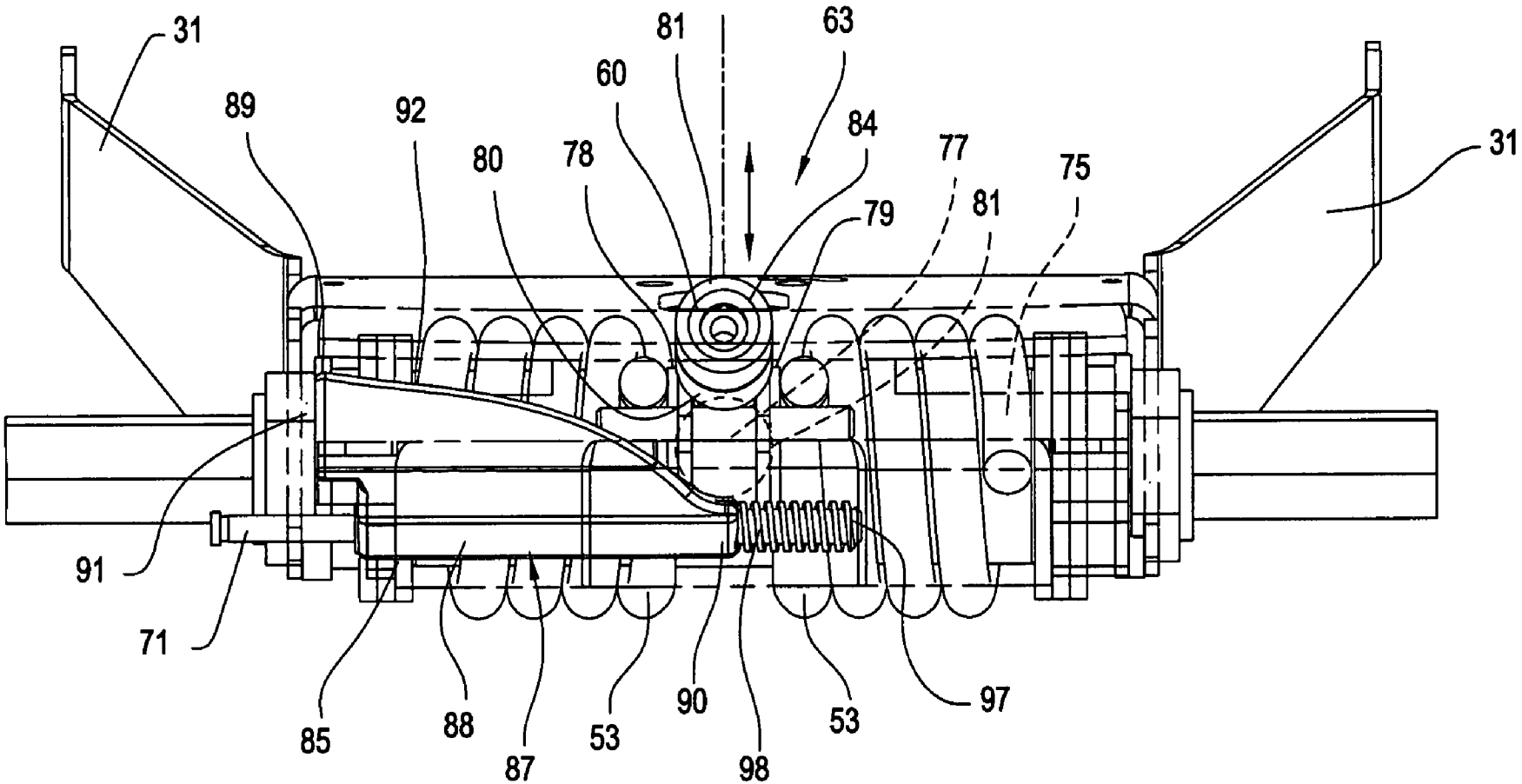
FIG. 4 is a rear elevational view of the tilt control mechanism in the operative condition of FIG. 3 with a spring roller illustrated in solid outline in a raised adjusted position and in phantom outline in an initial position.

The upper portion 89 of the block 70, however, has an arcuate, contoured shape or profile when viewed from the rear as seen in FIG. 4. More specifically, the leading end 90 of the block 70 has a relatively thin thickness, which thickness progressively increases to the opposite trailing end 91. This thickness increase preferably is non-linear so as to define a generally arcuate cam surface 92. This block 70 further has a three dimensional contour which is contoured in both the side to side direction when viewed from the back (FIG. 4) and the front to back direction when viewed from the end (FIG. 6) to provide optimum contact between this cam block 70 and the roller unit 63.

Figure 6:
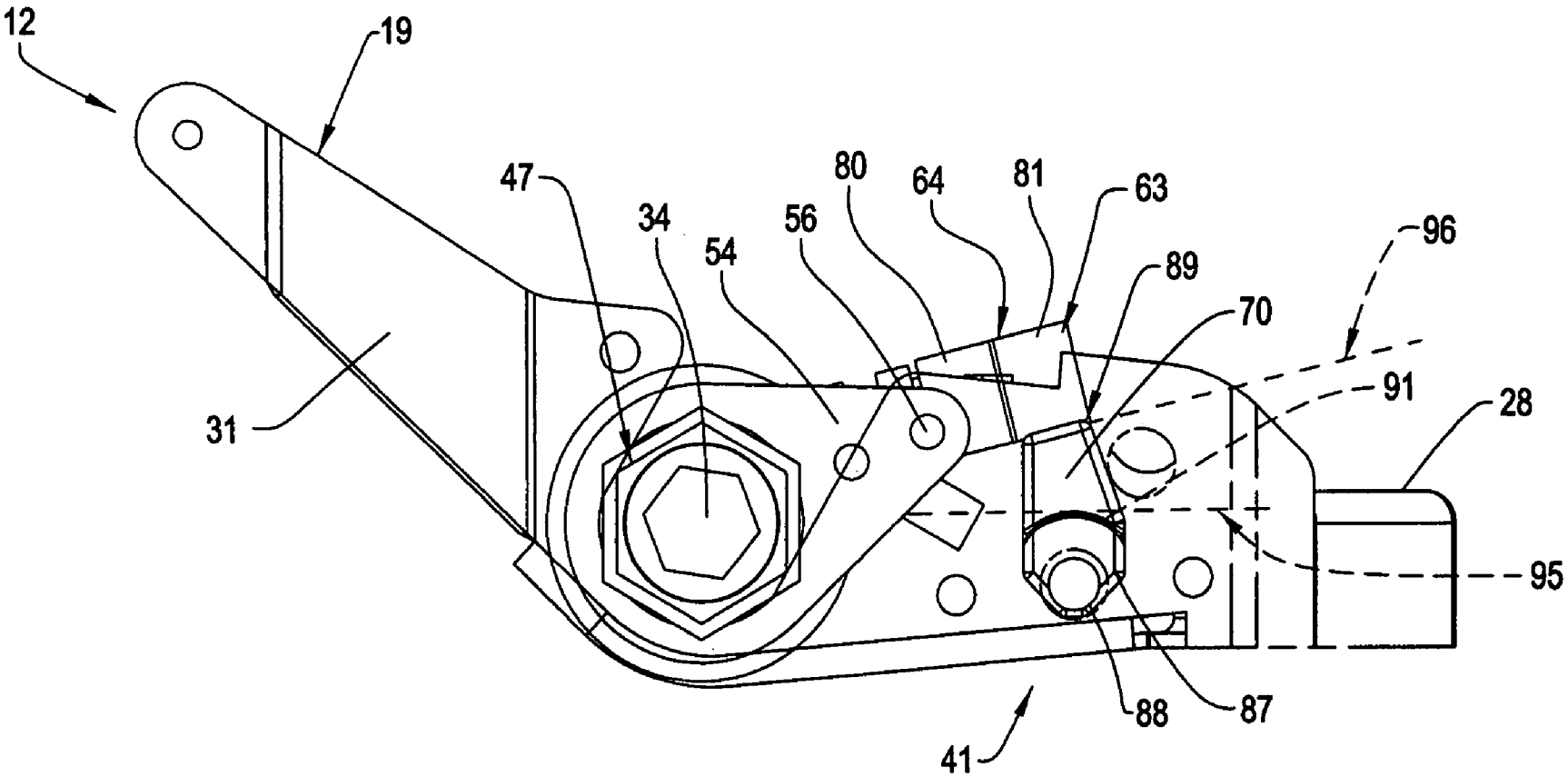
FIG. 6 is an enlarged side view thereof.

As seen in FIG. 6, the cam surface 92 at the leading block end 90 has its lower end edge sloped in the front to back direction as indicated in FIG. 6 by reference arrow 95. The opposite upper edge of the surface 92 at the trailing end 91 is sloped in the front to back direction along slope line 96 which slope line 96 is inclined to a greater degree than the shallower bottom slope line 95. This slope line thereby varies along the sideward length of the cam block 70. As briefly referenced above, the adjustment assembly 41 acts by this cam block 70 on the springs 51 to effect rotation of the adjustment arm 60 and thereby displace the lower spring legs 53 vertically.

Figure 5:
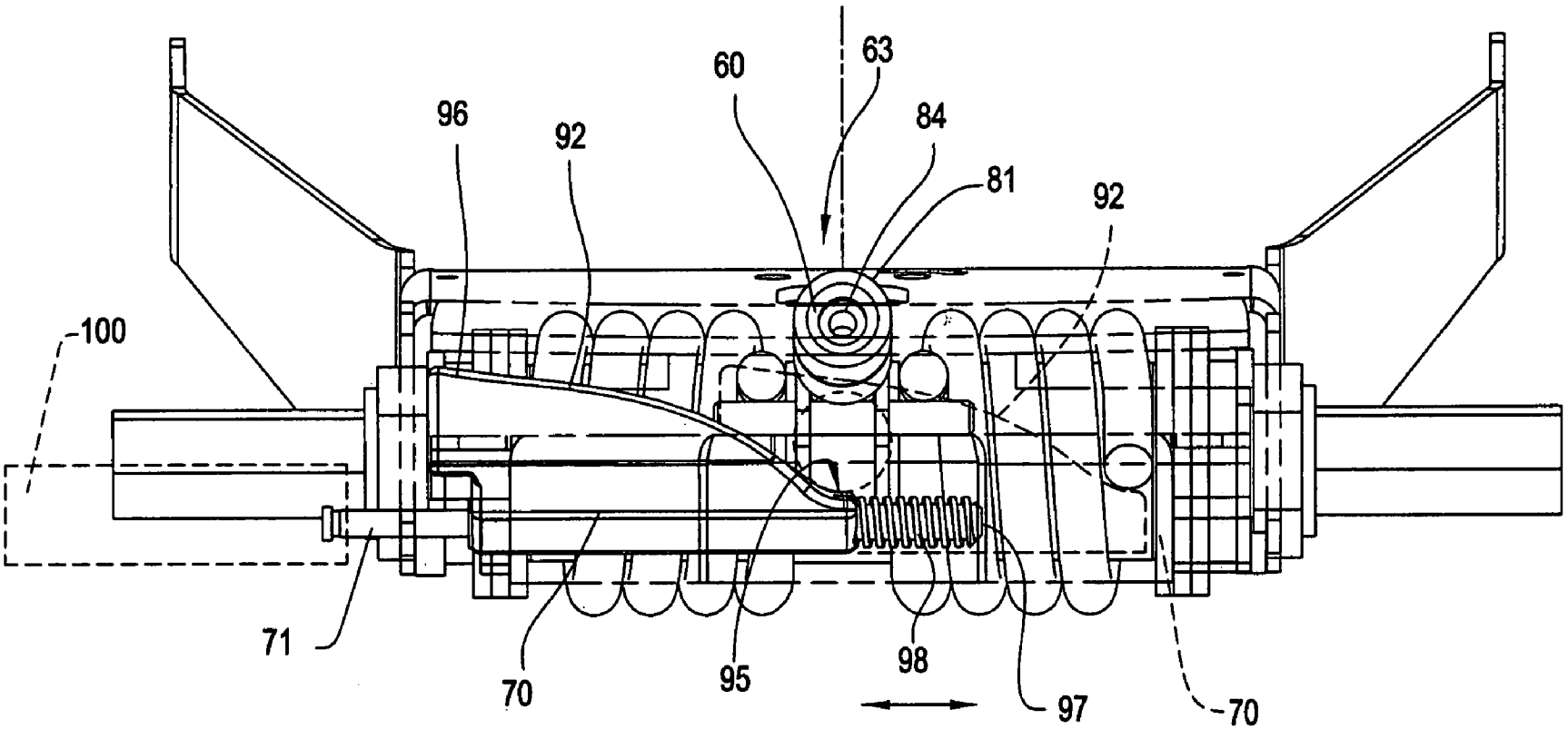
FIG. 5 is a rear elevational view illustrating the cam block in phantom outline in a displaced, adjusted position.

Referring to FIGS. 3 and 5, the adjustment assembly 41 comprises the threaded drive shaft 71 which has its outer end supported in rotatable engagement with the opening 48 of the control body 19. The opposite inner end 97 of the drive shaft 71 includes a threaded connector section 98 which is engaged with the cam block 70 such that shaft rotation drives the block 70 either inwardly in one direction to the phantom position of FIG. 5, or upon reverse shaft rotation, drive the block 71 outwardly toward the side wall 31 to the solid-outline position of FIG. 5. The cam block 70 fits into the guide channel 85 which ensures linear sliding of the block 70 along this guide channel 85.

The upper surface 92 of the cam block 70 is adapted to support the opposing circumferential surface of the roller 63. As seen in FIG. 4, the cam surface 92 is flat in the front-to-back direction but has a variable curvature which is relatively steep in the sideward direction. As such, the roller 63 rotates along the cam surface 92 as the cam block 70 moves sidewardly which thereby varies the vertical position of the roller 63 and effects angular displacement of the adjustment arm 60. During this angular arm displacement, the angular orientation of the roller 63 varies such that the contact angle that the roller 63 is in when it is in contact with the cam block 63 varies.

For example, in FIG. 4, when the cam block 70 is in the initial position, the roller 63 is at a first angle and a lowermost position relative to the housing bottom wall 32 as seen in phantom outline. The taper or contour of the cam surface 92, however, is designed so that continuous contact is provided along the entire width of this cam surface 92.

Thereafter, rotation of the adjustment shaft 71 causes the cam block 70 to move inwardly to the phantom adjusted position illustrated in FIG. 4, wherein the roller 63 essentially climbs upwardly along the cam surface 92 to its solid-outline position of FIG. 5 which thereby changes the angle of the roller 63 relative to the bottom body wall 32. Nevertheless, continuous line contact is still maintained across the width of the cam surface 92 since the taper, for example, taper 96 at the bottom end varies relative to the taper 97 at the top of the block 70. Thus, line contact is maintained despite relative movement of the adjustment arm 60 and cam block 70.

It is noted that the opposing arcuate surfaces of the block 70 and the roller 63 are subject to the spring load of the springs 51 which drives the roller 63 downwardly. Thus, this spring load maintains the opposing surfaces in contact with each other.

To effect rotation of the drive shaft 71, a handle 100 (FIG. 5) is affixed to the outer shaft end 101 and is manually rotated by the chair user. In this manner the hand piece 100 controls movement of the cam block 70 and varies the tilt tension generated by the springs 51.

Figure 7:
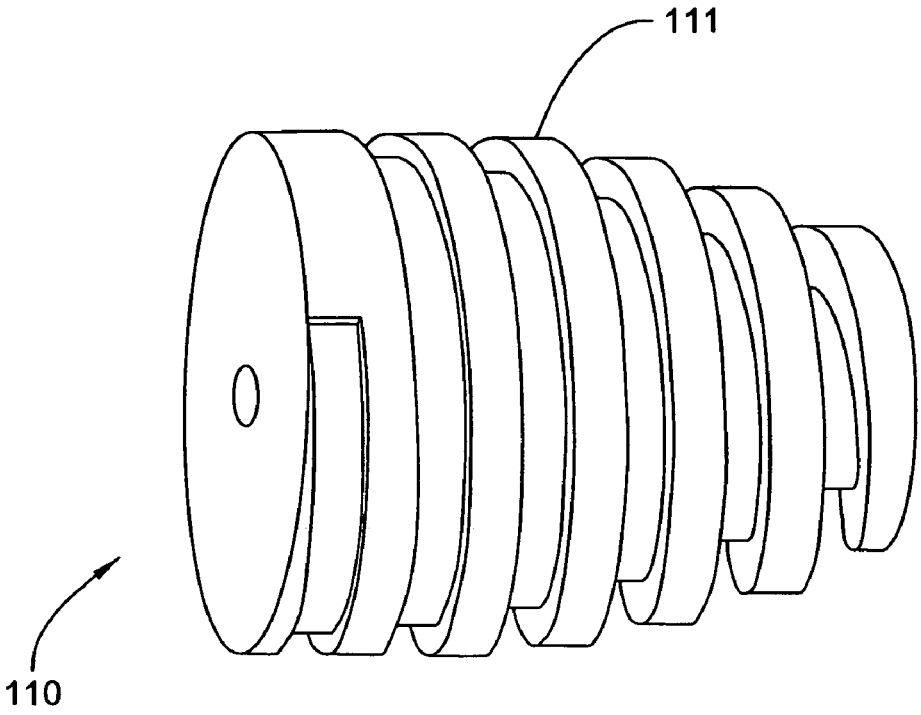
FIG. 7 is a rear isometric view of an alternative cam block in the form of a rotatable, tapered Acme screw block.
Figure 8:
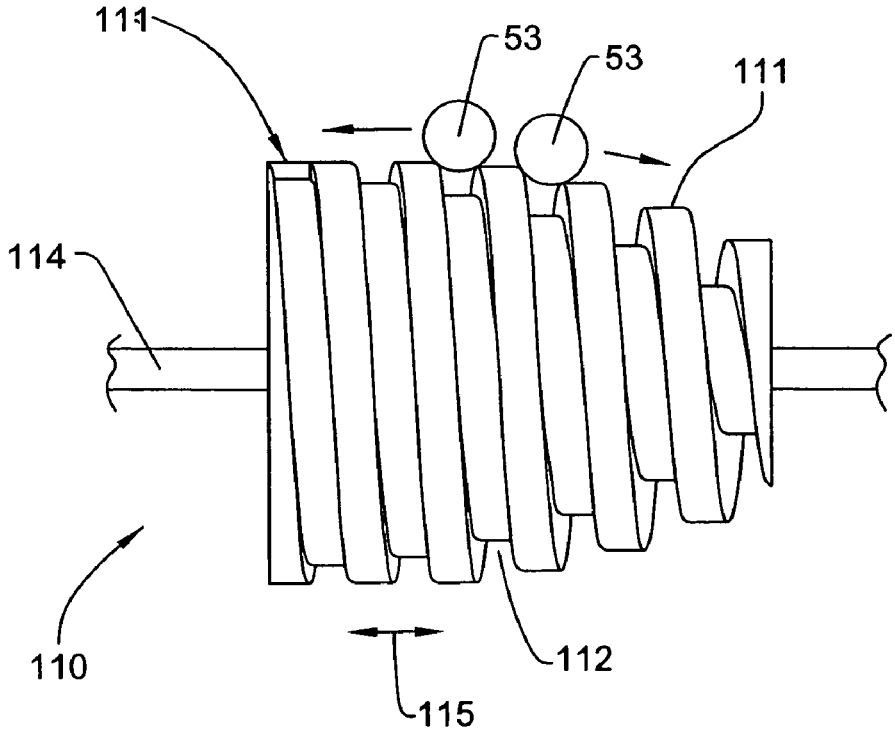
FIG. 8 is a rear elevational view of the rotatable cam block of FIG. 7 disposed in cooperation with the spring legs.

Turning to FIGS. 7 and 8, a further embodiment of the adjustment mechanism is illustrated therein and is identified by reference numeral 110. This mechanism 110 uses an alternative rotatable cam block 111 which is formed so as to have a tapered, generally conical shape. The outer surface 112 of the block 110 is formed with spiral Acme threads 112 which are configured to support the lower spring legs 53 directly thereon. The threads 112 tend to restrain the spring legs 53 axially and also define a contoured surface along which the spring legs 53 can travel vertically.

The cam block 111 is mounted on a drive shaft 114 which is rotated like the shaft 71 described above. As the shaft 114 is rotated, the block 111 travels sidewardly in the direction of reference arrow 115 like the linearly-displacable cam block 70. Due to the variable diameter of the cam block ill, the legs 53 are displaced radially upwardly or downwardly which thereby causes adjustment of the relative tension generated by the springs 51.

Although particular preferred embodiments of the invention has been disclosed in detail for illustrative purposes, it will be recognized that variations or modifications of the disclosed apparatus, including the rearrangement of parts, lie within the scope of the present invention.

What is claimed is:

1. A tension adjustment mechanism for controlling tilting resistance of a seat-back assembly in a chair, said tension adjustment mechanism comprising:

a control body;

a pivot member pivotally connected to said control body so as to pivot during tilting of said seat-back assembly;

a biasing member acting on said pivot member to resist pivoting of said pivot member and resist tilting of said seat-back assembly, said biasing member including at least one movable biasing element which is displaceable about a pivot axis in opposite first and second directions extending along a first adjustment path to progressively vary the tilting resistance generated by said biasing member, said biasing member having a cam surface associated therewith to effect displacement of said biasing element along said first adjustment path;

a cam member supported on said control body adjacent said biasing element which said cam member has a respective cam surface which supports said biasing element thereon, said cam member being actuatable along opposite third and fourth directions extending along a second adjustment path to displace said biasing element and progressively vary the tilting resistance, said second adjustment path being oriented transverse to said first adjustment path, and said cam member including said cam surface which is non-uniformly tapered in a sideward direction extending parallel to said second adjustment path to define a non-uniform contour along said cam surface which non-linearly varies the amount of displacement of said biasing element along said first adjustment path during movement of said cam member along said second adjustment path, said cam surface of said cam member further being sloped in a facing direction transverse to said second adjustment path so as to face toward said biasing element and maintain contact between said cam surfaces during movement of said cam member along said second adjustment path; and a drive arrangement having a rotatable adjustment shaft which extends sidewardly within said control body and is manually rotatable, said drive arrangement effecting displacement of said cam member along said second adjustment path by rotation of said adjustment shaft so that said cam member is sidewardly movable toward or away from said biasing element through said third and fourth directions depending upon the direction of rotation of said adjustment shaft, wherein movement of said cam member in said third direction toward said biasing element effects displacement of said biasing element in said second direction to counteract said biasing element, and movement of said cam member in said fourth direction away from said biasing element permits displacement of said biasing member in said first direction.

2. The tension adjustment mechanism according to claim 1, wherein said cam surfaces on said cam member and said biasing element are arcuate so as to each have a curved taper extending along said second adjustment path.

3. The tension adjustment mechanism according to claim 2, wherein at least one of said opposing cam surfaces has an inclined slope in a front to back direction transverse to said second adjustment path to maintain line contact between and across the front to back width of said opposing cam surfaces.

4. The tension adjustment mechanism according to claim 1, wherein said cam surface of said cam member has a three dimensional contoured surface which tapers sidewardly along said second adjustment path and has an inclined slope in the front to back direction transverse to said second adjustment path to maintain line contact between said opposing cam surfaces across a front to back width thereof during displacement of said cam member.

5. The tension adjustment mechanism according to claim 1, wherein said biasing member comprises at least one coil spring which said coil spring includes a first spring leg which defines said biasing element.

6. The tension adjustment mechanism according to claim 5, wherein said coil spring includes a second spring leg which is displaced by said pivot member during pivoting thereof wherein the relative positions between the first and second spring legs defines the tilt resistance.

7. The tension adjustment mechanism according to claim 1, wherein said cam surface associated with said biasing element is defined by a roller supported on a pivoting adjustment member.

8. A tension adjustment mechanism for controlling resistance to tilting of a seat-back assembly of a chair, said tension adjustment mechanism comprising:

a mechanism body;

a pivot member pivotally attached to said mechanism body which said pivot member pivots about a horizontal pivot axis in response to tilting of said seat-back assembly;

a biasing member acting on said pivot member so as to resist said tilting wherein said biasing member includes a biasing element which is displaceable in opposite directions to vary the tilting resistance;

an adjustment member having a first portion supporting said biasing element wherein said biasing element applies a biasing force against said adjustment member, said adjustment member further including an arcuate cam surface, and being pivotally supported by said mechanism body so as to pivot about a horizontal pivot axis along a first adjustment path; and a drive arrangement comprising a cam member having an arcuate cam surface disposed in opposing relation with and in sliding contact with said opposing arcuate cam surface on said adjustment member, said cam member being reversibly displaceable sidewardly along a second adjustment path transverse to said first adjustment path by a manual actuator to effect displacement of said adjustment member along said first adjustment path to vary the relative position of said biasing element and vary the tilt resistance, said arcuate cam surface of said cam member having a three-dimensional contour which is tapered in a side-to-side direction along said second adjustment path and sloped in a front-to-back direction transverse to said second adjustment path to maintain continuous contact across a front-to-back width of said opposing arcuate cam surfaces during changes in the orientation of said arcuate cam surface on said adjustment member during pivoting of said adjustment member by said cam member.

9. The tension adjustment mechanism according to claim 8, wherein said control body includes first guide structure which confines movement of said cam member to said second adjustment path, and second guide structure which confines movement of said biasing element to said first adjustment path.

10. The tension adjustment mechanism according to claim 8, wherein said biasing member is a coil spring having a first spring leg defining said biasing element and a second spring leg which is displaced by said pivot member during pivoting thereof wherein the relative positions of said first and second spring legs varies the tilting resistance.

11. The tension adjustment mechanism according to claim 10, wherein said biasing member comprises a coil spring having said first and second spring legs projecting tangentially therefrom.

12. The tension adjustment mechanism according to claim 11, which includes a pivot shaft on which said coil springs are supported coaxially therewith, said adjustment member also being pivotally supported by said support shaft.

13. The tension adjustment mechanism according to claim 8, wherein said slope varies in the sideward direction.

14. The tension adjustment mechanism according to claim 1, wherein said control body includes first guide structure which confines movement of said cam member to said second adjustment path, and second guide structure which confines movement of said biasing element to said first adjustment path.

15. The tension adjustment mechanism according to claim 1, wherein said cam member has a leading end closest to said biasing element and a trailing end spaced away therefrom, wherein said leading end defines a first slope in said facing direction and said trailing end defines a second slope in said facing direction which is steeper than said first slope such that said cam surface maintains continuous contact as said biasing element travels along said cam member from said leading end to said trailing end.

* * * * *